US010422228B2

(12) United States Patent
Castle et al.

(10) Patent No.: US 10,422,228 B2
(45) Date of Patent: Sep. 24, 2019

(54) MANUFACTURING A MONOLITHIC COMPONENT WITH DISCRETE PORTIONS FORMED OF DIFFERENT METALS

(71) Applicant: United Technologies Corporation, Farmington, CT (US)

(72) Inventors: Lea Kennard Castle, Vernon, CT (US); Mario P. Bochiechio, Vernon, CT (US)

(73) Assignee: United Technologies Corporation, Farmington, CT (US)

( * ) Notice: Subject to any disclaimer, the term of this patent is extended or adjusted under 35 U.S.C. 154(b) by 168 days.

(21) Appl. No.: 15/096,544

(22) Filed: Apr. 12, 2016

(65) Prior Publication Data

US 2017/0292382 A1 Oct. 12, 2017

(51) Int. Cl.

| | |
|---|---|
| ***B22D 19/00*** | (2006.01) |
| ***B22D 19/04*** | (2006.01) |
| ***B22D 19/16*** | (2006.01) |
| ***B22D 21/00*** | (2006.01) |
| ***B22D 25/02*** | (2006.01) |
| ***B22D 27/04*** | (2006.01) |
| ***F01D 5/14*** | (2006.01) |

(Continued)

(52) U.S. Cl.

CPC ..... *F01D 5/147* (2013.01); *B22D 19/0054* (2013.01); *B22D 19/0081* (2013.01); *B22D 19/04* (2013.01); *B22D 19/10* (2013.01); *B22D 19/16* (2013.01); *B22D 21/005* (2013.01); *B22D 25/02* (2013.01); *B22D 27/045* (2013.01); *F01D 5/28* (2013.01); *F04D 29/324* (2013.01); *F04D 29/325* (2013.01); *F04D 29/38* (2013.01); *F05D 2220/32* (2013.01); *F05D 2230/21* (2013.01); *F05D 2300/10* (2013.01)

(58) Field of Classification Search

CPC ..... B22D 19/00; B22D 19/0054; B22D 19/0081; B22D 19/04; B22D 19/10; B22D 19/16; B22D 21/00; B22D 21/005; B22D 25/02; B22D 27/04; B22D 27/045

USPC ..... 164/94, 95, 100, 122.2, 76.1

See application file for complete search history.

(56) References Cited

U.S. PATENT DOCUMENTS

| | | | | |
|---|---|---|---|---|
| 3,847,203 A | | 11/1974 | Northwood | |
| 5,238,046 A | * | 8/1993 | Guerard | B02C 4/305 164/110 |

(Continued)

FOREIGN PATENT DOCUMENTS

| | | | | |
|---|---|---|---|---|
| GB | 723646 | | 2/1955 | |
| JP | 61-182863 A | * | 8/1986 | B22D 13/02 |
| WO | 2015017111 A1 | | 2/2015 | |

OTHER PUBLICATIONS

Partial EP Search Report for EP Appln. No. 17165900.6 dated Aug. 16, 2017.

EP office action for EP17165900.6 dated Apr. 30, 2019.

*Primary Examiner* — Kevin P Kerns

(74) *Attorney, Agent, or Firm* — O'Shea Getz P.C.

(57) ABSTRACT

Methods are provided for manufacturing a component. In one method, first metal material is cast into a first body. At least a portion of the first body is machined. Second metal material is cast onto at least the machined portion of the first body to form a monolithic second body. A first portion of the second body is formed by the first metal material, A second portion of the second body is formed by the second metal material. The second metal material is different from the first metal material.

21 Claims, 10 Drawing Sheets

(51) Int. Cl.

| | |
|---|---|
| ***F04D 29/32*** | (2006.01) |
| ***F04D 29/38*** | (2006.01) |
| ***F01D 5/28*** | (2006.01) |
| ***B22D 19/10*** | (2006.01) |

(56) References Cited

U.S. PATENT DOCUMENTS

| | | | | |
|---|---|---|---|---|
| 5,395,699 | A | 3/1995 | Ernst et al. | |
| 6,820,678 | B2 * | 11/2004 | Ishiduka et al. ..... | B22D 17/00 164/112 |
| 7,560,171 | B2 * | 7/2009 | Shiraishi et al. ..... | B22D 19/00 164/98 |
| 7,762,309 | B2 | 7/2010 | Tamaddoni-Jahromi et al. | |
| 7,832,986 | B2 | 11/2010 | Baker et al. | |
| 8,342,229 | B1 * | 1/2013 | Ziani et al. ..... | B22D 17/08 164/113 |
| 8,905,203 | B2 * | 12/2014 | Lee et al. ..... | B22D 19/16 164/98 |
| 2011/0123828 | A1 * | 5/2011 | Svensson et al. ..... | B22D 19/06 428/682 |
| 2014/0037981 | A1 | 2/2014 | Cui et al. | |
| 2015/0020757 | A1 | 1/2015 | Highum | |
| 2015/0328681 | A1 | 11/2015 | Bullied et al. | |

* cited by examiner

MANUFACTURING A MONOLITHIC COMPONENT WITH DISCRETE PORTIONS FORMED OF DIFFERENT METALS

BACKGROUND OF THE INVENTION

1. Technical Field

This disclosure relates generally to manufacturing a metal component and, more particularly, to casting a metal component.

2. Background Information

Various methods are known in the art for casting metal components. While these methods have various benefits, there is still a need in the art for an improved method for casting. In particular, there is a need in the art for an improved method for casting a metal component which includes discrete portions of different metals with more than one metal.

SUMMARY OF THE DISCLOSURE

According to an aspect of the present disclosure, a method is provided for manufacturing a component. During this method, first metal material is cast into a first body. At least a portion of the first body is machined. Second metal material is cast onto at least the machined portion of the first body to form a monolithic second body. A first portion of the second body is formed by the first metal material. A second portion of the second body is formed by the second metal material. The second metal material is different from the first metal material.

According to another aspect of the present disclosure, a method is provided for manufacturing a component for a gas turbine engine. During this method, molten first metal material is directed into a first casting mold. The first metal material is solidified to form a first body. The first body is removed from the first casting mold. An operation is performed on at least a portion of the first body. The first body is arranged with a second casting mold. Molten second metal material is directed into the second casting mold. The molten second metal material contacts the portion of the first body. The second metal material is different from the first metal material. The second metal material is solidified to form a second body. A first portion of the second body is formed by the solidified first metal material. A second portion of the second body is formed by the solidified second metal material.

According to still another aspect of the present disclosure, another method is provided for manufacturing a component for a gas turbine engine. During this method, a first body is arranged with a casting mold. The first body is configured from or otherwise includes first metal material. Molten second metal material is directed into the casting mold. The molten second metal material contacts at least a portion of the first body. The second metal material is different from the first metal material. The second metal material is solidified to form a monolithic second body. A first portion of the second body is formed by the solidified first metal material. A second portion of the second body is formed by the solidified second metal material. The first metal material in the first portion of the second body has a substantially single crystal microstructure. The second metal material in the second portion of the second body has a substantially single crystal microstructure.

During the method, the second body may be removed from the second casting mold. An operation may be performed on at least a portion of the second body. The second body may be arranged with a third casting mold. Molten third metal material may be directed into the third casting mold. The molten third metal material may contact the portion of the second body and the second metal material. The third metal material may be different from the second metal material. The third metal material may be solidified to form a third body. A first portion of the third body may be formed by the solidified first metal material. A second portion of the third body may be formed by the solidified second metal material. A third portion of the third body may be formed by the solidified third metal material.

The operation may be or include a machining operation.

The first metal material and the second metal material may be solidified to provide the second body with a substantially single crystal microstructure.

During the method, at least the portion of the first body may be machined.

The casting of the first metal material may include steps of: directing the first metal material, in molten form, into a casting mold; and solidifying the first metal material to form the first body.

The first metal material may be solidified to provide the first body with a substantially single crystal microstructure.

During the method, the first body may be removed from the casting mold. The first body may be arranged with a second casting mold. The second metal material may be cast onto at least the machined portion of the first body within the second casting mold.

The casting of the second metal material may include steps of: directing the second metal material, in molten form, into a casting mold, the molten second metal material contacting the machined portion of the first body; and solidifying the second metal material to form the second body.

The first metal material and the second metal material may be solidified to provide the second body with a substantially single crystal microstructure.

During the method, at least a portion of the second body may be machined. Third metal material may be cast onto at least the machined portion of the second body to form a monolithic third body. A first portion of the third body may be formed by the first metal material. A second portion of the third body may be formed by the second metal material. A third portion of the third body may be formed by the third metal material. The third metal material may be different from at least the first metal material and/or the second metal material.

During the method, at least a portion of the second body may be machined. Third metal material may be cast onto at least the portion of the second body.

The third metal material may be different from the first metal material and the second metal material.

The casting of the third metal material may include steps of: directing the third metal material, in molten form, into a casting mold, the molten third metal material contacting the machined portion of the second body and the second metal material; and solidifying the third metal material to form the third body.

The first metal material, the second metal material and the third metal material may be solidified to provide the third body with a substantially single crystal microstructure.

The machining of the portion of the first body may include a step of removing at least one of overcast material, material with one or more defects and/or porous material from the first body.

The component may be a rotor blade and include an airfoil extending radially out from a platform. An interface between the first metal material and the second metal material may be at the platform.

The component may be a rotor blade and include an airfoil. An interface between the first metal material and the second metal material may be at a position along a radial span of the airfoil.

The component may be a rotor blade and include an airfoil and a root. An interface between the first metal material and the second metal material may be within the root.

The foregoing features and the operation of the invention will become more apparent in light of the following description and the accompanying drawings.

DETAILED DESCRIPTION OF THE INVENTION

Figure 1:
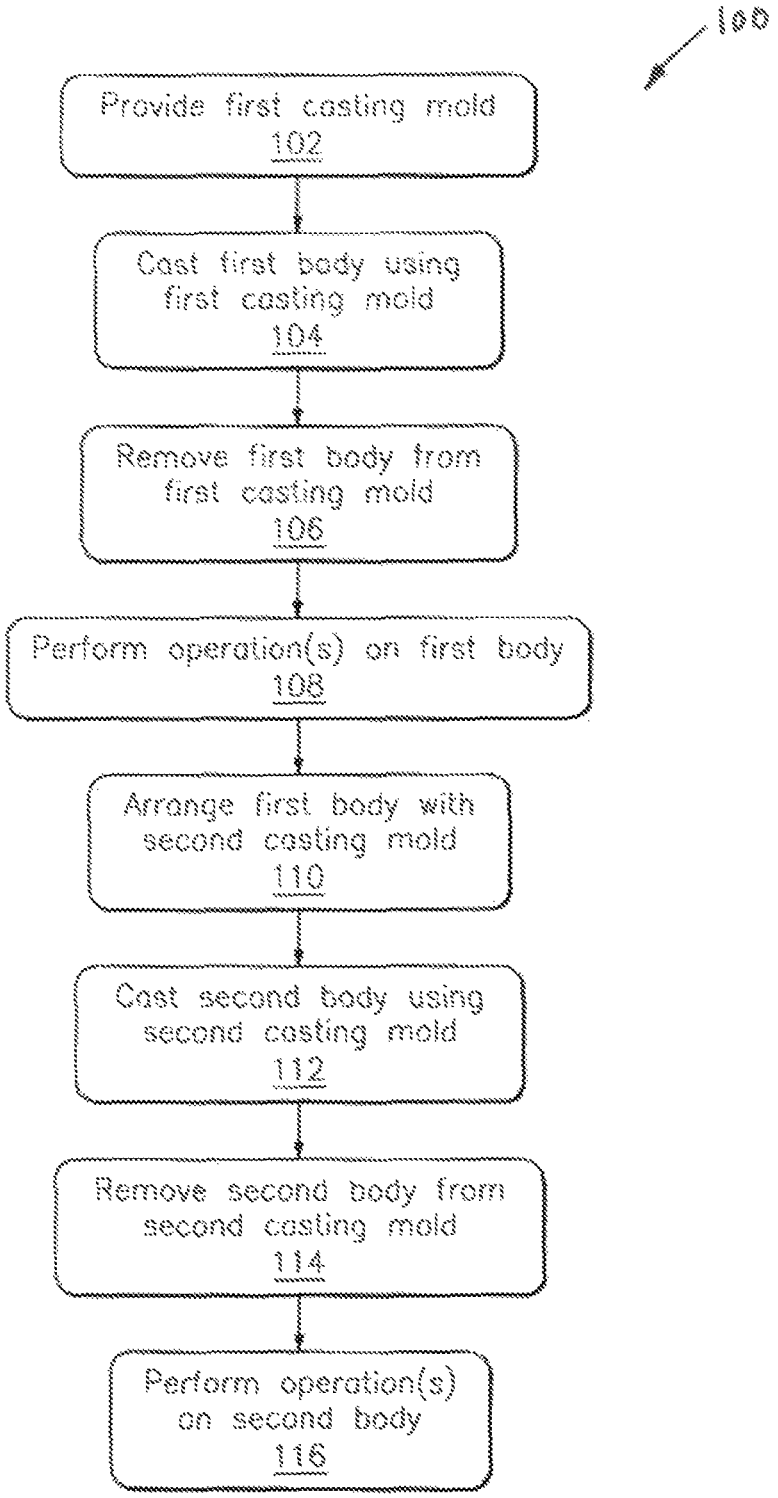
FIG. 1 is a flow diagram of a method for manufacturing a component.
Figure 2:
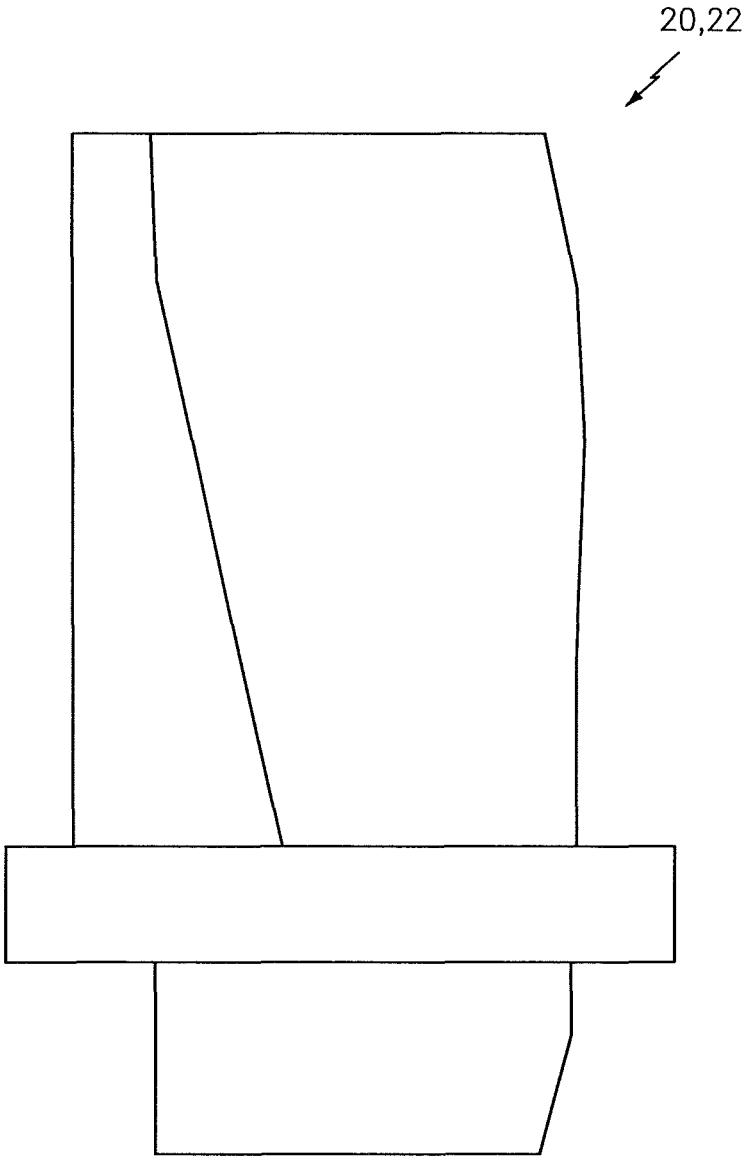
FIG. 2 is an illustration of a component which may be manufactured using methods according to the present disclosure.

FIG. 1 is a flow diagram of a method 100 for manufacturing a component 20. An exemplary embodiment of such a component 20 is a rotor blade 22 of a gas turbine engine as generally illustrated in FIG. 2. This rotor blade 22 may be configured as a compressor blade or a turbine blade. Alternatively, the rotor blade 22 may be configured as a fan blade. The method 100 of the present disclosure, however, is not limited to manufacturing rotor blades. The method 100, for example, may also be performed to manufacture a gas turbine engine component such as, but not limited to, a stator vane, a guide vane or a nozzle vane. Furthermore, the method of 100 may also be performed to manufacture components for a non-gas turbine engine application such as, but not limited to, a turbo charger wheel.

Figure 3:
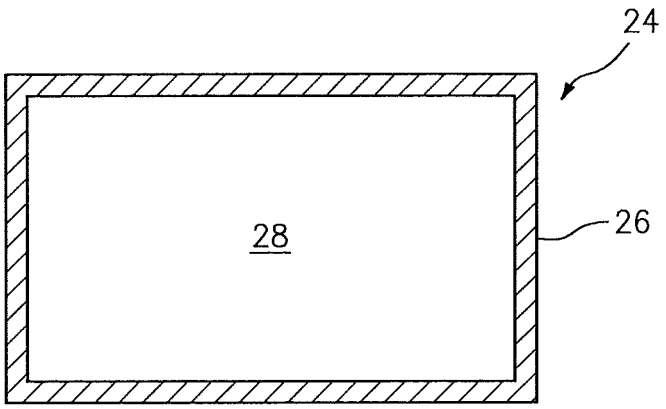
FIG. 3 is a representational illustration of a first casting mold.

In step 102, a first casting mold 24 is provided. An exemplary representation of the first casting mold 24 is illustrated in FIG. 3. This first casting mold 24 includes an outer shell 26 and an internal cavity 28 formed by and within the outer shell 26.

The first casting mold 24 may be formed using various techniques. For example, mold material such as ceramic may be applied to and built-up around at least one wax form. After the mold material is built-up to form the outer shell 26, the wax form may be heated to melt the wax. The liquid wax is subsequently be removed from the first casting mold 24 through an aperture (not shown) and thereby leave a negative space (i.e., the internal cavity 28) within the outer shell 26.

Figure 4:
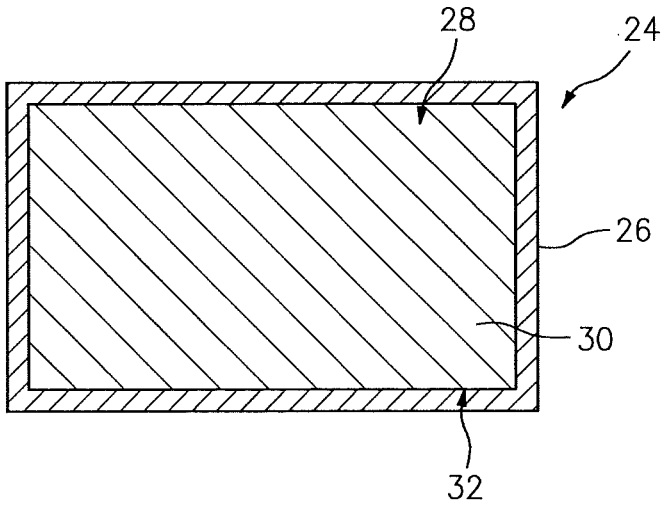
FIG. 4 is a representational illustration of the first casting mold filled with first metal material.

In step 104, first metal material 30 (e.g., a metal alloy) is cast into a first body 32. In particular, the first metal material 30, in molten form, is directed (e.g., pored, injected, etc.) into the internal cavity 28 of the first casting mold 24. The internal cavity 28 may be substantially completely filled with the molten first metal material 30 as illustrated in FIG. 4. Alternatively, the internal cavity 28 may be partially filled to a certain level with the molten first metal material 30.

Subsequent to (and/or during) the filling of the internal cavity 28 with the molten first metal material 30, the first metal material 30 is solidified to form the first body 32. This solidification may be performed to provide the first body 32 with certain material properties. For example, the first metal material 30 may be solidified using various cooling techniques to provide the first body 32 with a substantially single crystal microstructure. The term "single crystal" may refer to a microstructure with a pattern of single crystal dendrites, where substantially all of the dendrites are solidified in a common crystallographic orientation. Metal materials with such a single crystal microstructure may exhibit anisotropic properties, lack grain boundaries, and/or have relatively high creep strength.

Figure 5:
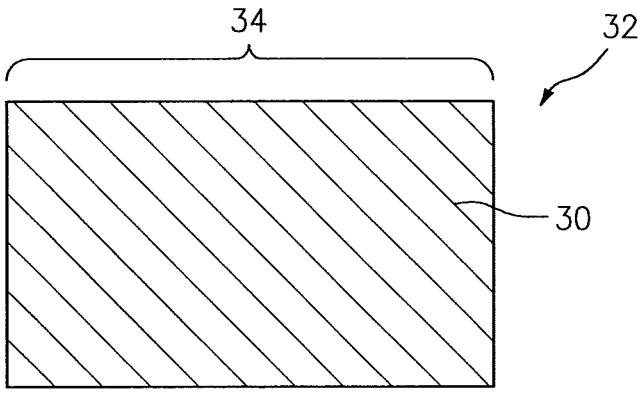
FIG. 5 is a representational illustration of a first body formed from the first metal material.

In step 106, the first body 32 is removed from the first casting mold 24. The first casting mold 24, for example, may be broken or otherwise taken apart to reveal the first body 32 (see FIG. 5).

In step 108, at least one operation is performed on at least a portion 34 of the first body 32. The portion 34 of the first body 32, for example, may be machined to ensure the first body 32 has a specified surface finish and/or a specified geometry; e.g., shape and dimensions. The portion 34 of the first body 32 may also or alternatively be machined to remove overcast material, material with one or more defects and/or porous material from the first body 32. Examples of such machining operations include, but are not limited to, chemical milling, media blasting, mechanical and/or laser machining, grinding, sanding and buffing. Of course, one or more operations other than a machining operation may also or alternatively be performed on the portion 34 of the first body 32 (and/or elsewhere on the first body 32). Examples of such other operations include, but are not limited to, surface treating operations, heat treating operations, material buildup/joining operations (e.g., welding), and leaching/autoclave processing to remove potential ceramic core fracture(s).

Figure 6:
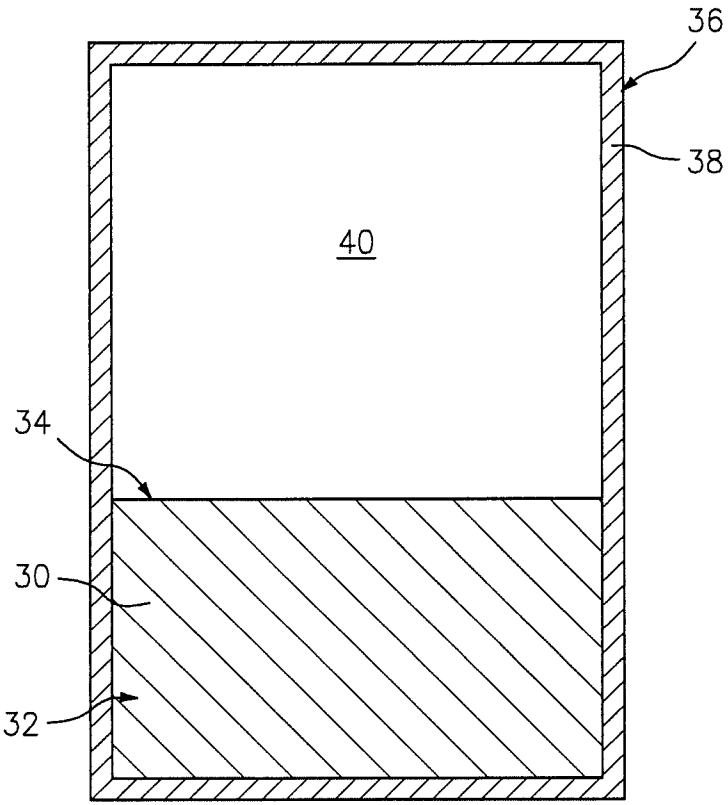
FIG. 6 is a representational illustration of the first body arranged with a second casting mold.

In step 110, the first body 32 is arranged with a second casting mold 36. An exemplary representation of the second casting mold 36 arranged with the first body 32 is illustrated in FIG. 6. This second casting mold 36 includes an outer shell 38 and an internal cavity 40 partially formed by and within the outer shell 38. The first body 32 may be disposed within the outer shell 38, and forms a peripheral side of the internal cavity 40.

The first body 32 may be arranged within the second casting mold 36 by forming the outer shell 38 around the first body 32 using various techniques. For example, mold material such as ceramic may be applied to and built-up around at least one wax form disposed adjacent to the portion 34 of the first body 32. After the mold material is built-up to form the outer shell 38, the wax form may be heated to melt the wax. The liquid wax is subsequently removed from the second casting mold 36 through an aperture (not shown) and thereby leave a negative space (i.e., the internal cavity 40) within the outer shell 38.

Figure 7:
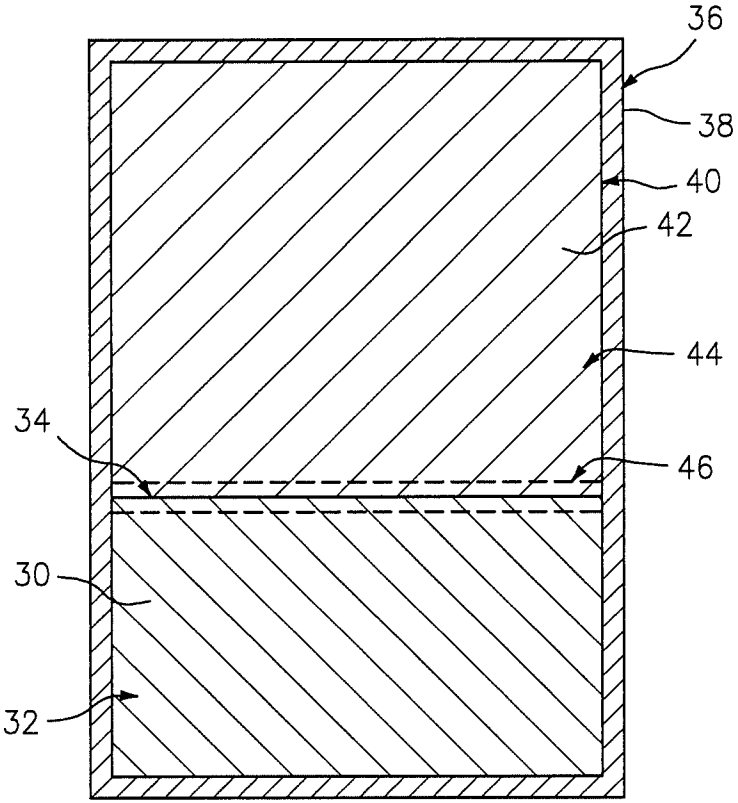
FIG. 7 is a representational illustration of the second casting mold filled with second metal material.

In step 112, second metal material 42 (e.g., a metal alloy) is cast onto at least the portion 34 of the first body 32 to form a monolithic second body 44 of the metal materials 30 and 42, where the first and the second metal materials 30 and 42 are different from one another. In particular, the second metal material 42, in molten form, is directed (e.g., poured, injected, etc.) into the internal cavity 40 of the second casting mold 36 and onto the first body 32 and its solidified first metal material 30 as illustrated in FIG. 7. Upon contacting the molten second metal material 42, a portion of the solidified first metal material 30 may melt and bond and/or alloy with an adjacent portion of the molten second metal material 42; e.g., see encircled interface region 46.

The internal cavity 40 may be substantially completely filled with the molten second metal material 42 as illustrated in FIG. 7. Alternatively, the internal cavity 40 may be partially filled to a certain level with the molten second metal material 42.

Subsequent to (and/or during) the filling of the internal cavity 40 with the molten second metal material 42, the second metal material 42 is solidified to form the second body 44. This solidification may be performed to provide the second body 44 with certain material properties. For example, the second metal material 42 may be solidified using various cooling techniques to provide the second body 44 with a substantially single crystal microstructure. Here, the second metal material 42 is solidified to replicate/continue the microstructure of the previously solidified first metal material 30. Thus, the previously solidified first metal material 30 and, thus, the first body 32 provides a crystallographic seed for the casting of the second metal material 42.

In step 114, the second body 44 is removed from the second casting mold 36. The second casting mold 36, for example, may be broken or otherwise taken apart to reveal the second body 44 as illustrated in FIG. 8.

In step 116, one or more additional operations are performed to the second body 44 to provide the finished component 20. Examples of such operations include, but are not limited to, machining operations, surface treating operations, heat treating operations, material buildup/joining operations (e.g., welding), coating operations, and leaching/autoclave processing to remove potential ceramic core fracture(s).

Figure 8:
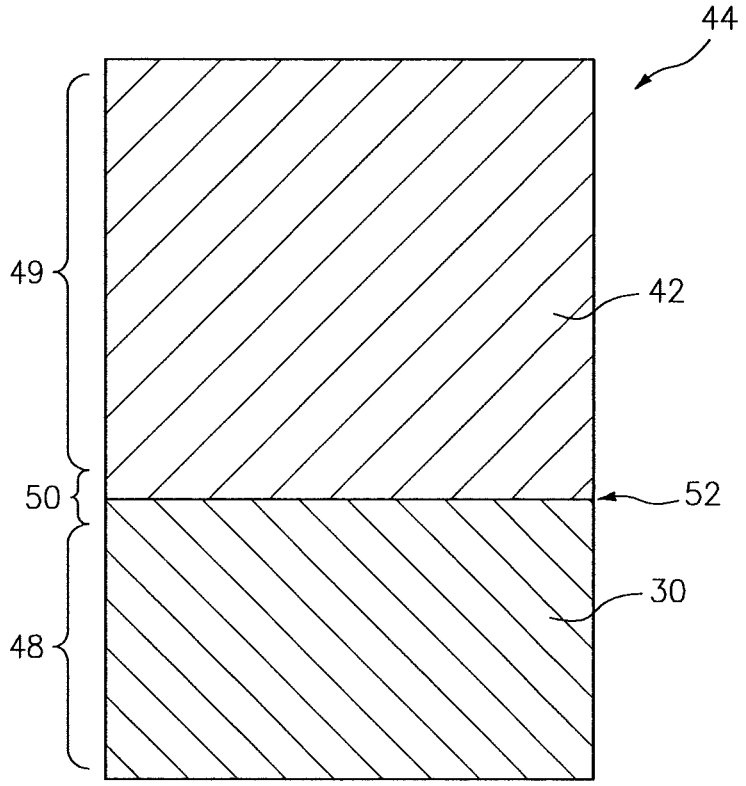
FIG. 8 is a representational illustration of a second body formed from the first and the second metal materials.

The finished component 20 (as well as the second body 44) includes a plurality of material portions 48-50; see FIG. 8. The first portion 48 is formed by the first metal material 30. The second portion 49 is formed by the second metal material 42. The third portion 50 (e.g., interface portion) is formed by the bonded and/or alloyed first and second metal materials 30 and 42. This third portion 50 is at the interface 52 between the first portion 48 and the second portion 49.

Figure 11:
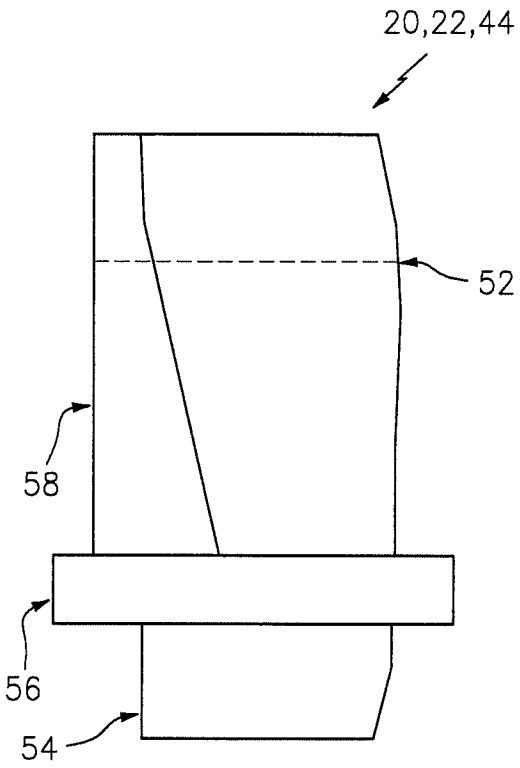
FIGS. 9-11 are illustrations of components which may be manufactured using the method of FIG. 1.
Figure 10:
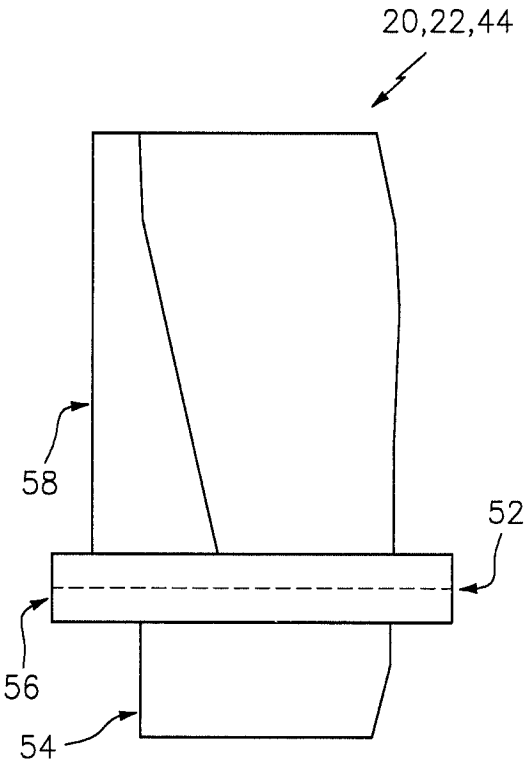
Figure 9:
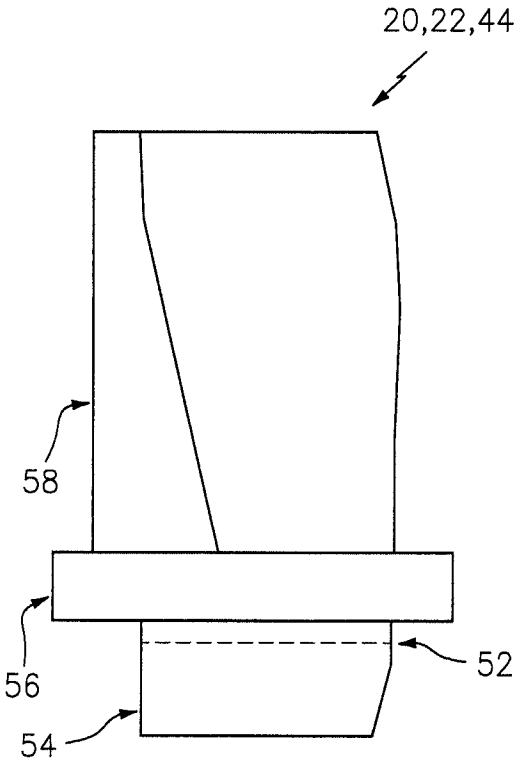

With the foregoing configuration, the first portion 48 of the component 20 exhibits properties (e.g., strength, ductility, creep resistance, etc.) associated with the first metal material 30 and the second portion 49 of the component 20 exhibits properties associated with the second metal material 42. Thus, the first and the second metal materials 30 and 42 may be selected based on which operational forces and/or environmental conditions the portions 48 and 49 of the component 20 are expected to be subjected. For example, where the first portion 48 forms a base portion of the component 20 (e.g., rotor blade) as illustrated in FIGS. 9-11, the first metal material 30 may be selected to exhibit a first property or properties. Correspondingly, where the second portion 49 forms an outer portion of the component 20 (e.g., rotor blade) as illustrated in FIGS. 9-11, the second metal material 42 may be selected to exhibit a second property or properties. The first and second properties may be different/varied, or have certain commonalities. Examples of first and second properties include, but are not limited to, low density/weight; high melting temperature (not point); creep strength; wear resistance; oxidation resistance and tensile strength.

Examples of metal materials from which the first and second metal materials 30 and 42 may be selected are outlined in Table 1 below. The present disclosure, however, is not limited to the exemplary metal materials below. In addition, while the exemplary metal materials below are all metal alloys, the first metal material 30 and/or the second metal material 42 may alternatively be selected to be pure metals depending on the specific component 20 requirements.

TABLE 1

| Alloy Trade Name | PWA 1480 | Rene' N4 | CMSX-3 | PWA 1484 | Rene' N5 | CMSX-4 |
|---|---|---|---|---|---|---|
| Cr (% wt.) | 10.0 | 9.8 | 8.0 | 5.0 | 7.0 | 6.5 |
| Co (% wt.) | 5.0 | 7.5 | 5.0 | 10.0 | 7.5 | 9.0 |
| Mo (% wt.) | — | 1.5 | 0.6 | 2.0 | 1.5 | 0.6 |
| W (% wt.) | 4.0 | 6.0 | 8.0 | 6.0 | 5.0 | 6.0 |
| Ta (% wt.) | 12.0 | 4.8 | 6.0 | 9.0 | 6.5 | 6.5 |
| Re (% wt.) | — | — | — | 3.0 | 3.0 | 3.0 |
| Nb (% wt.) | — | 0.5 | — | — | — | — |
| Al (% wt.) | 5.0 | 4.2 | 5.6 | 5.6 | 6.2 | 5.6 |
| Ti (% wt.) | 1.5 | 3.5 | 1.0 | — | — | 1.0 |
| Hf (% wt.) | — | 0.15 | 0.10 | 0.10 | 0.15 | 0.10 |
| C (% wt.) | — | 0.05 | — | — | 0.05 | — |
| B (% wt.) | — | 0.00 | — | — | 0.00 | — |
| Y (% wt.) | — | — | — | — | 0.01 | — |

In addition to the selecting the types of metal materials used in the component 20, the method 100 may be performed to tailor a location of the interface 52 within the component 20 by adjusting the relative percent-by-volumes of the first and the second metal materials 30 and 42 and, thus, the first and the second regions 48 and 49. For example, the interface 52 may be located within a root 54 of the component 20 as illustrated in FIG. 9. The interface 52 may be located in (or adjacent to) a platform 56 of the component 20 as illustrated in FIG. 10. The interface 52 may be located along a radial span of an airfoil 58 of the component 20 as illustrated in FIG. 11. For example, the interface 52 may be located at a position between about fifty percent (50%) and about seventy-five percent (75%) span as illustrated in FIG. 11; e.g., about 70% span. However, in other embodiments, the interface 52 may be located at other positions; e.g., between zero percent (0%) and about twenty-five percent (25%) span; between about twenty-five percent (25%) and about fifty percent (50%) span; or between about seventy-five percent (75%) and about ninety percent (90%) span. The location of the interface may be selected based on the design and thermal exposure during operation.

Figure 12:
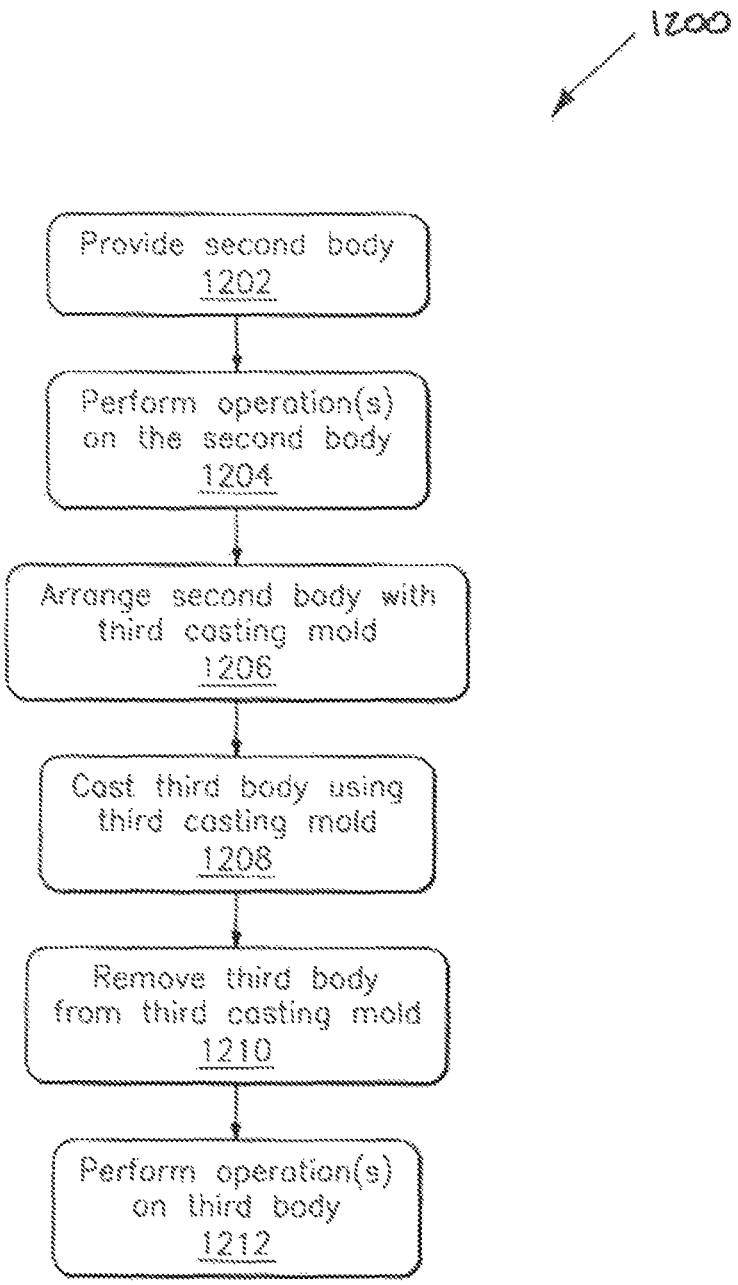
FIG. 12 is a flow diagram of another method for manufacturing a component.
Figure 13:
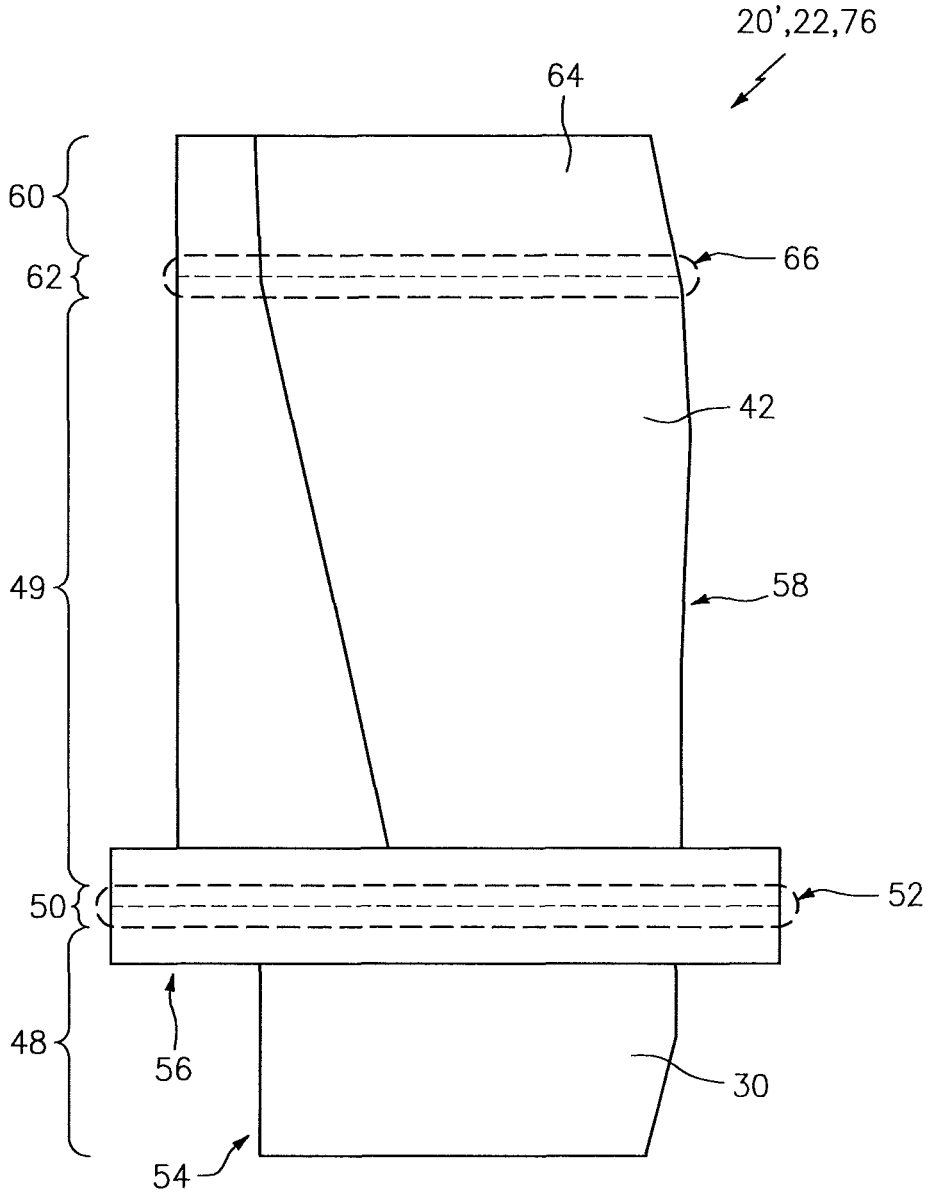
FIG. 13 is an illustration of a component which may be manufactured using the method of FIG. 12.

FIG. 12 is a flow diagram of another method 1200 for manufacturing a component 20'; e.g., see FIG. 13. In contrast to the component 20 of FIGS. 9-10, the component 20' of FIG. 13 is formed with at least five material portions 48-50, 60 and 62. The first portion 48 is formed by the first metal material 30. The second portion 49 is formed by the second metal material 42. The third portion 50 (e.g., interface portion) is formed by the bonded and/or alloyed first and second metal materials 30 and 42. This third portion 50 is at the interface 52 between the first portion 48 and the second portion 49. The fourth portion 60 is formed by third metal material 64 (e.g., a metal alloy), which is different than at least the second metal material 42 and may also be different than (or the same as) the first metal material 30. The fifth portion 62 (e.g., interface portion) is formed by the bonded and/or alloyed second and third metal materials 42 and 64. This fifth portion 62 is at an interface 66 between the second portion 49 and the fifth portion 62.

In step 1202, the steps 102, 104, 106, 108, 110, 112 and 114 of the method 100 are perforated to form the second body 44 as described above. The method 1200, of course, is not limited to such a second body formation method.

In step 1204, at least one operation is perforated on at least a portion 68 of the second body 44 (see FIG. 14), which portion 68 is formed of the second metal material 42. The portion 68 of the second body 44, for example, may be machined to ensure the second body 44 has a specified surface finish and/or a specified geometry; e.g., shape and dimensions. The portion 68 of the second body 44 may also or alternatively be machined to remove overcast material, material with one or more defects and/or porous material from the second body 44. Of course, one or more operations other than a machining operation may also or alternatively be performed on the portion 68 of the second body 44 (and/or elsewhere on the second body 44) as described above with reference to the step 108.

Figure 14:
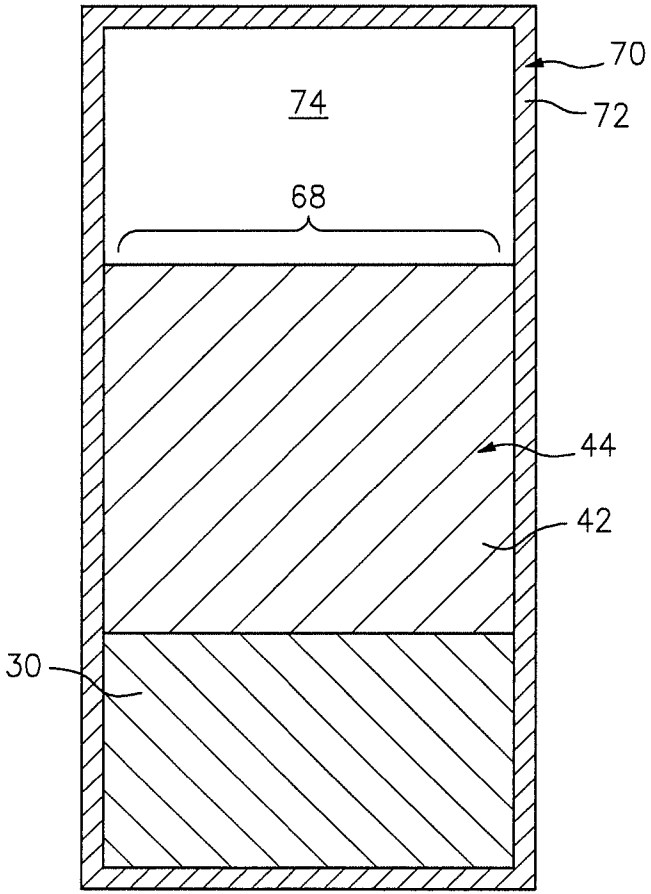
FIG. 14 is a representational illustration of the second body arranged with a third casting mold.

In step 1206, the second body 44 is arranged with a third casting mold 70. An exemplary representation of the third casting mold 70 arranged with the second body 44 is illustrated in FIG. 14. This third casting mold 70 includes an outer shell 72 and an internal cavity 74 partially formed by and within the outer shell 72. The second body 44 may be disposed within the outer shell 72, and forms a peripheral side of the internal cavity 74.

The second body 44 may be arranged with the third casting mold 70 by forming the outer shell 72 around the second body 44 using various techniques. For example, mold material such as ceramic may be applied to and built-up around at least one wax form disposed adjacent to the portion 68 of the second body 44. After the mold material is built-up to form the outer shell 72, the wax form may be heated to melt the wax. The liquid wax will subsequently be removed from the third casting mold 70 through an aperture (not shown) and thereby leave a negative space (i.e., the internal cavity 74) within the outer shell 72.

Figure 15:
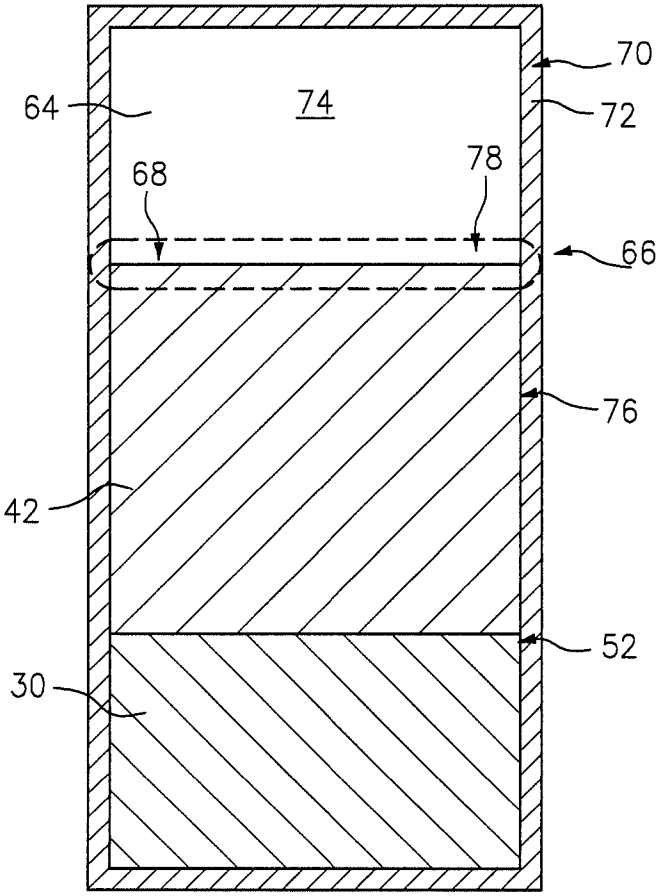
FIG. 15 is a representational illustration of the third casting mold filled with third metal material.

In step 1208, third metal material 64 is cast onto at least the portion 68 of the second body 44 to form a monolithic third body 76 (see also FIG. 13) of the metal materials 30, 42 and 64. In particular, the third metal material 64, in molten form, is directed (e.g., poured, injected, etc.) into the internal cavity 74 of the third casting mold 70 and onto the second body 44 and its solidified second metal material 42 as illustrated in FIG. 15. Upon contacting the molten third metal material 64, a portion of the solidified second metal material 42 may melt and bond and/or alloy with an adjacent portion of the molten third metal material 64; e.g., see encircled interface region 78.

The internal cavity 74 may be substantially completely filled with the molten third metal material 64 as illustrated in FIG. 15. Alternatively, the internal cavity 74 may be partially filled to a certain level with the molten third metal material 64.

Subsequent to (and/or during) the filling of the internal cavity 74 with the molten third metal material 64, the third metal material 64 is solidified to form the third body 76. This solidification may be performed to provide the third body 76 with certain material properties. For example, the third metal material 64 may be solidified using various cooling techniques to provide the third body 76 with a substantially single crystal microstructure.

In step 1210, the third body 76 is removed from the third casting mold 70. The third casting mold 70, for example, may be broken or otherwise taken apart to reveal the third body 76; e.g., see FIG. 13.

In step 1212, one or more additional operations are performed to the third body 76 to provide the finished component 20'. Examples of such operations include, but are not limited to, machining operations, surface treating operations, heat treating operations, material buildup/joining operations (e.g., welding), coating operations, and leaching/autoclave processing to remove potential ceramic core fracture(s).

In some embodiments, the method 1200 may be modified such that the component 20' formed therefrom includes more than three metal materials. For example, before performing the step 1212, the steps 1204, 1206, 1208 and 1210 may be repeated at least one additional time to form yet another body from the third body 76 and another metal material casting.

In some embodiments, the order of the steps in the methods 100 and 1200 may be reversed or otherwise reordered. For example, by reversing certain steps in the method 100, the second portion 49 of the component 20, 20' may be formed before and beneath the first portion 48 of the component 20, 20'; e.g., the root 54 may be formed after and on top of the airfoil 58.

In some embodiments, one or more of the metal materials (e.g., 30, 42, 64) may be directionally solidified using various cooling techniques to provide the first body 32 with a microstructure other than a single crystal microstructure described above; e.g., columnar microstructure. The term "directional solidification" may refer to a methodology for solidifying cast molten material where the solidifying of the molten material first starts at a base end of the casting mold (or adjacent previously solidified material within the casting mold). In other embodiments, one or more of the metal materials (e.g., 30, 42, 64) may alternatively be conventionally cast, and thereby provide one or more regions of the component 20, 20' with other types of microstructures; e.g., an equiax microstructure.

In some embodiments, the component 20, 20' material at one or more of the interfaces 52, 66 (e.g., interface regions 46, 50, 62, 78) may have a continuous microstructure. Alternatively, this component 20, 20' material may have a non-continuous single crystal dendrite microstructure. For example, the component 20, 20' material may have some low-angle and/or high-angle boundaries within the microstructure.

Figure 16:
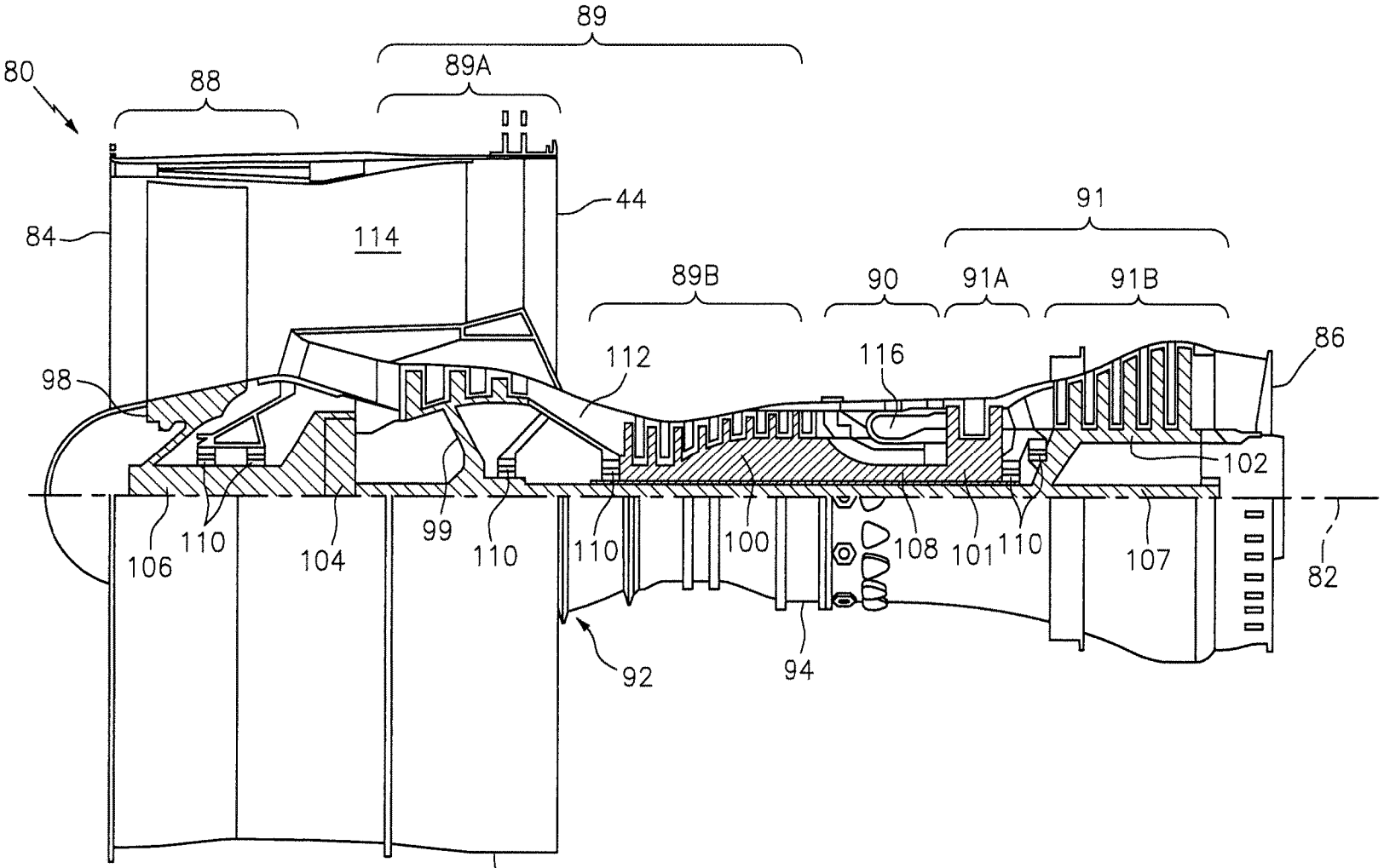
FIG. 16 is a side cutaway illustration of a gas turbine engine.

As described above, the component 20, 20' formed by the methods of the present disclosure may be configured with various different types and configurations of rotational equipment, or other devices. FIG. 16 illustrates one such type and configuration of the rotational equipment—a geared turbofan gas turbine engine 80. This turbine engine 80 includes various types and configurations of rotor blades (described below), where the component 20, 20' can be configured as anyone of the foregoing rotor blades, or other structures not mentioned herein.

Referring still to FIG. 16, the turbine engine 80 extends along an axial centerline 82 between an upstream airflow inlet 84 and a downstream airflow exhaust 86. The turbine engine 80 includes a fan section 88, a compressor section 89, a combustor section 90 and a turbine section 91. The compressor section 89 includes a low pressure compressor (LPC) section 89A and a high pressure compressor (HPC) section 89B. The turbine section 91 includes a high pressure turbine (HPT) section 91A and a low pressure turbine (LPT) section 91B.

The engine sections 88-91 are arranged sequentially along the centerline 82 within an engine housing 92. This housing 92 includes an inner case 94 (e.g., a core case) and an outer case 96 (e.g., a fan case). The inner case 94 may house one or more of the engine sections 89-91; e.g., an engine core. The outer case 96 may house at least the fan section 88.

Each of the engine sections 88, 89A, 89B, 91A and 91B includes a respective rotor 98-102. Each of these rotors 98-102 includes a plurality of rotor blades arranged circumferentially around and connected to one or more respective rotor disks. The rotor blades, for example, may be formed integral with or mechanically fastened, welded, brazed, adhered and/or otherwise attached to the respective rotor disk(s).

The fan rotor 98 is connected to a gear train 104, for example, through a fan shaft 106. The gear train 104 and the LPC rotor 99 are connected to and driven by the LPT rotor 102 through a low speed shaft 107. The HPC rotor 100 is connected to and driven by the HPT rotor 101 through a high speed shaft 108. The shafts 106-108 are rotatably supported by a plurality of bearings 110; e.g., rolling element and/or thrust bearings. Each of these bearings 110 is connected to the engine housing 92 by at least one stationary structure such as, for example, an annular support strut.

During operation, air enters the turbine engine 80 through the airflow inlet 84. This air is directed through the fan section 88 and into a core gas path 112 and a bypass gas path 114. The core gas path 112 flows sequentially through the engine sections 89-91. The bypass gas path 114 flows away from the fan section 88 through a bypass duct, which circumscribes and bypasses the engine core. The air within the core gas path 112 may be referred to as "core air". The air within the bypass gas path 114 may be referred to as "bypass air".

The core air is compressed by the compressor rotors 99 and 100 and directed into a combustion chamber 116 of a combustor in the combustor section 90. Fuel is injected into the combustion chamber 116 and mixed with the compressed core air to provide a fuel-air mixture. This fuel air mixture is ignited and combustion products thereof flow through and sequentially cause the turbine rotors 101 and 102 to rotate. The rotation of the turbine rotors 101 and 102 respectively drive rotation of the compressor rotors 100 and 99 and, thus, compression of the air received from a core airflow inlet. The rotation of the turbine rotor 102 also drives rotation of the fan rotor 98, which propels bypass air through and out of the bypass gas path 114. The propulsion of the bypass air may account for a majority of thrust generated by the turbine engine 80, e.g., more than seventy-five percent (75%) of engine thrust. The turbine engine 80 of the present disclosure, however, is not limited to the foregoing exemplary thrust ratio.

The component 20, 20' may be included in various turbine engines other than the one described above as well as in other types of rotational or non-rotational equipment. The component 20, 20', for example, may be included in a geared turbine engine where a gear train connects one or more shafts to one or more rotors in a fan section, a compressor section and/or any other engine section. Alternatively, the component 20, 20' may be included in a turbine engine configured without a gear train. The component 20, 20' may be included in a geared or non-geared turbine engine configured with a single spool, with two spools (e.g., see FIG. 16), or with more than two spools. The turbine engine may be configured as a turbofan engine, a turbojet engine, a propfan engine, a pusher fan engine or any other type of turbine engine; e.g., a land based turbine engine for power generation. The present disclosure therefore is not limited to any particular types or configurations of turbine engines or equipment.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined with any one of the aspects and remain within the scope of the invention. Accordingly, the present invention is not to be restricted except in light of the attached claims and their equivalents.

What is claimed is:

1. A method for manufacturing a component, comprising:

casting first metal material into a first body;

machining at least a portion of the first body to remove select material from the first body; and casting second metal material onto at least the machined portion of the first body to form a monolithic second body, a first portion of the second body formed by the first metal material, and a second portion of the second body formed by the second metal material, wherein the second metal material is different from the first metal material;

wherein, during the casting of the second metal material, a solidified portion of the first metal material melts and bonds to and/or alloys with an adjacent portion of the second metal material.

2. The method of claim 1, wherein the casting of the first metal material comprises:

directing the first metal material, in molten form, into a casting mold; and solidifying the first metal material to form the first body.

3. The method of claim 2, wherein the first metal material is solidified to provide the first body with a substantially single crystal microstructure.

4. The method of claim 2, further comprising:

removing the first body from the casting mold;

arranging the first body with a second casting mold;

wherein the second metal material is cast onto at least the machined portion of the first body within the second casting mold.

5. The method of claim 1, wherein the casting of the second metal material comprises:

directing the second metal material, in molten form, into a casting mold, the molten second metal material contacting the machined portion of the first body; and solidifying the second metal material to form the second body.

6. The method of claim 5, wherein the first metal material and the second metal material are solidified to provide the second body with a substantially single crystal microstructure.

7. The method of claim 1, further comprising:

machining at least a portion of the second body; and casting third metal material onto at least the machined portion of the second body to form a monolithic third body, a first portion of the third body formed by the first metal material, a second portion of the third body formed by the second metal material, and a third portion of the third body formed by the third metal material, wherein the third metal material is different from at least the first metal material and/or the second metal material.

8. The method of claim 7, wherein the third metal material is different from the first metal material and the second metal material.

9. The method of claim 7, wherein the casting of the third metal material comprises:

directing the third metal material, in molten form, into a casting mold, the molten third metal material contacting the machined portion of the second body and the second metal material; and solidifying the third metal material to form the third body.

10. The method of claim 9, wherein the first metal material, the second metal material and the third metal material are solidified to provide the third body with a substantially single crystal microstructure.

11. The method of claim 1, wherein the select material comprises at least one of overcast material, material with one or more defects and/or porous material.

12. The method of claim 1, wherein the component is a rotor blade and comprises an airfoil extending radially out from a platform, and an interface between the first metal material and the second metal material is at the platform.

13. The method of claim 1, wherein the component is a rotor blade and comprises an airfoil, and an interface between the first metal material and the second metal material is at a position along a radial span of the airfoil.

14. The method of claim 1, wherein the component is a rotor blade and comprises an airfoil and a root, and an interface between the first metal material and the second metal material is within the root.

15. The method of claim 1, wherein the machining comprises chemical milling, media blasting, mechanical machining, laser machining, grinding, sanding or buffing.

16. A method for manufacturing a component for a gas turbine engine, comprising:

directing molten first metal material into a first casting mold;

solidifying the first metal material to form a first body;

removing the first body from the first casting mold;

performing an operation on at least a portion of the first body;

arranging the first body with a second casting mold;

directing molten second metal material into the second casting mold, the molten second metal material contacting the portion of the first body, wherein the second metal material is different from the first metal material; and solidifying the second metal material to form a second body, a first portion of the second body formed by the solidified first metal material, a second portion of the second body formed by the solidified second metal material, and the second metal material chemically bonded to the first metal material in an interface region between the first portion and the second portion.

17. The method of claim 16, further comprising:

removing the second body from the second casting mold;

performing an operation on at least a portion of the second body;

arranging the second body with a third casting mold;

directing molten third metal material into the third casting mold, the molten third metal material contacting the portion of the second body and the second metal material, wherein the third metal material is different from the second metal material; and solidifying the third metal material to form a third body, a first portion of the third body formed by the solidified first metal material, a second portion of the third body formed by the solidified second metal material, and a third portion of the third body formed by the solidified third metal material.

18. The method of claim 16, wherein the operation comprises a machining operation.

19. The method of claim 16, wherein the first metal material and the second metal material are solidified to provide the second body with a substantially single crystal microstructure.

20. A method for manufacturing a component of a gas turbine engine, comprising:

arranging a first body with a casting mold, the first body comprising first metal material, and the first body formed outside of the casting mold, wherein the first body is solid before and when arranged with the casting mold;

directing molten second metal material into the casting mold, the molten second metal material contacting at least a portion of the first body, wherein the second metal material is different from the first metal material; and solidifying the second metal material to form a monolithic second body, a first portion of the second body formed by the solidified first metal material, a second portion of the second body formed by the solidified second metal material, and the second metal material alloyed with the first metal material in an interface region between the first portion and the second portion;

wherein the first metal material in the first portion of the second body has a substantially single crystal microstructure, and the second metal material in the second portion of the second body has a substantially single crystal microstructure.

21. The method of claim 20, further comprising machining at least the portion of the first body.

* * * * *